United States Patent [19]

Yahata

[11] Patent Number: 4,938,156

[45] Date of Patent: Jul. 3, 1990

[54] METHOD FOR VOLUME REDUCTION OF ION-EXCHANGE RESIN

[75] Inventor: Taneaki Yahata, Oarai, Japan

[73] Assignee: Japan Atomic Energy Research Institute, Tokyo, Japan

[21] Appl. No.: 318,826

[22] Filed: Mar. 6, 1989

[30] Foreign Application Priority Data

Mar. 28, 1988 [JP] Japan ..... 63-71958

[51] Int. Cl.[5] ..... F23G 7/00

[52] U.S. Cl. ..... 110/346; 110/237; 110/245; 110/345

[58] Field of Search ..... 110/237, 245, 342, 343, 110/344, 345, 210, 211, 346

[56] References Cited

U.S. PATENT DOCUMENTS

| | | | |
|---|---|---|---|
| 4,351,249 | 9/1982 | Inovius | 110/210 |
| 4,388,877 | 6/1983 | Molayem et al. | 110/344 X |
| 4,636,335 | 1/1987 | Kawamura et al. | 110/237 X |

*Primary Examiner*—Edward G. Favors

*Attorney, Agent, or Firm*—Oblon, Spivak, McClelland, Maier & Neustadt

[57] ABSTRACT

A process for combustion of ion-exchange resin which comprises introducing an ion-exchange resin and air into a fluidized bed reaction zone which is heated to initially combust said resin and thereafter contacting soot and other unburned materials from said fluidized bed reaction zone, in a region above the fluidized bed reaction zone, with a catalyst to effect further catalytic combustion.

8 Claims, 1 Drawing Sheet

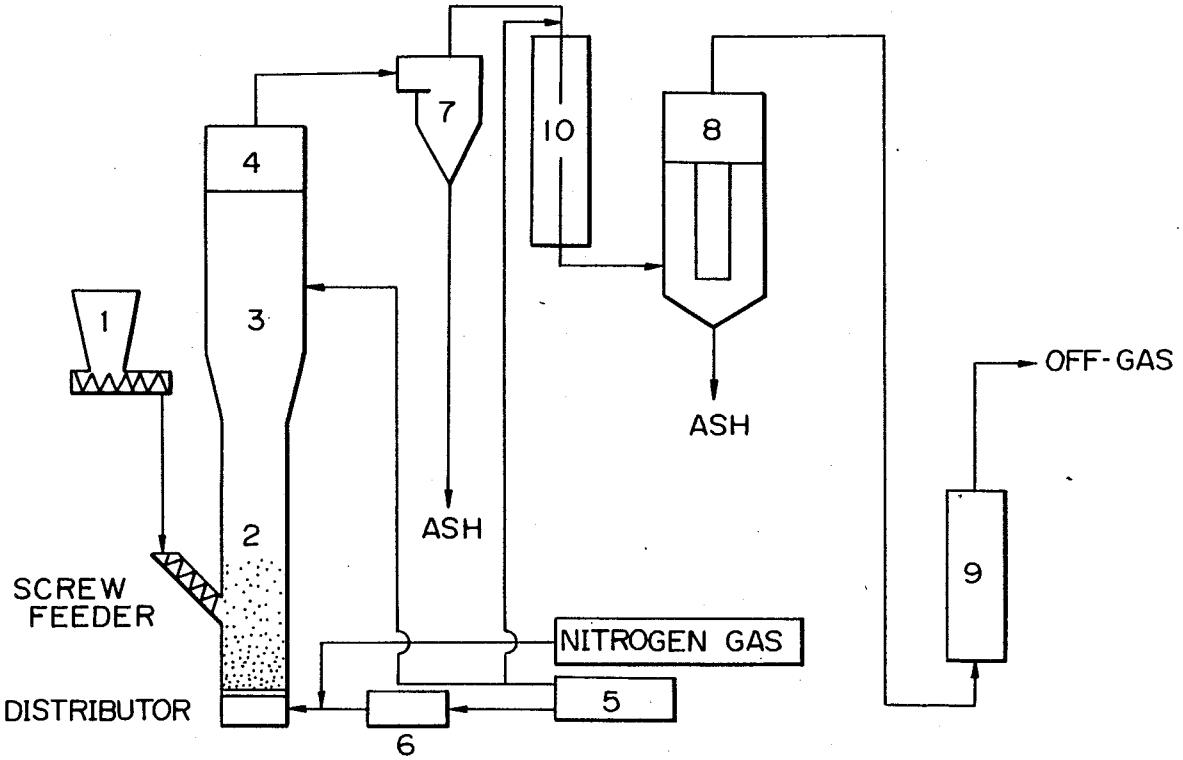
OFF-GAS
9
8
ASH
10
7
ASH
NITROGEN GAS
5
6
4
3
2
1
SCREW FEEDER
DISTRIBUTOR

METHOD FOR VOLUME REDUCTION OF ION-EXCHANGE RESIN

BACKGROUND OF THE INEVNTION (a) Field of the Invention

The present invention relates to a method for volume reduction of ion-exchange resin. More particularly, the present invention relates to a method of reducing the volume of ion-exchange resin by catalyst combustion, which is utilized as a volume reduction process of ion-exchange resin contaminated with radionuclide.

(b) Description of the Prior Art

Various ion-exchange resins contaminated with radionuclide are generated from a nuclear power plant, a nuclear fuel processing plant, a reprocessing plant, and etc.

As a volume reduction process of these resins, an acid digesting method and an incinerating method using an incinerator have been developed.

However, the acid digesting method has such a defect as being difficult in operation because of handling an acid at elevated temperatures and being attended with secondary waste disposal of acid.

On the other hand, when burning up the radioactive contaminant in a incinerator, its complete combustion is very difficult because it is operated under reduced pressure.

Burning-up of unburned materials has been attempted using an after-burner, but its effect is little under reduced pressure and a mesh-clogging of high-efficiency particluate air-filter is caused thereby.

Burning-up of ion-exchange resin producing plenty of soot is not technically established at present time, and so ion-exchange resins used are stored as they are.

SUMMARY OF THE INVENTION

An ion-exchange resin can be completely burned by burning it at 650°-850° C. under supplying air while unburned materials are catalytically reacted with a catalyst such as copper oxide, iron oxide, and etc. mounted on an incinerator and/or a catalyst reaction furnace.

BRIEF DESCRIPTION OF THE DRAWING

FIGURE is a diagram illustrating an embodiment of the present invention.

In FIGURE,

1. Ion-exchange resin feeder;
2. Fluidized bed;
3. Free board;
4. Catalyst (Copper oxide net, stainless steel net);
5. Compressor;
6. Air heater;
7. Cyclone;
8. Filter made of sintered metal;
9. Cooling tower;
10. Catalyst reaction furnace

DESCRIPTION OF THE EMBODIMENT

An object of the present inevntion is to provide a method for burning soot and other unburned materials completely, which are surely produced at the time of incineration of ion-exchange resin.

As the result of having made researches in improving the defects of the prior art, the present inventor has found that soot and other unburned organic materials produced by the incineration of ion-exchange resin can be completely burned by passing then through a catalyst such as copper oxide, iron oxide, nickel oxide, cobalt oxide and a mixture thereof to contact, and has reached the present invention.

In putting the present invention in practice, an ion-exchange resin is supplied continuously to a fluidized bed comprising a fluidized medium of alumina particle heated at 650°-850° C. while flowing air by means of an air compressor.

The ion-exchange resin is pyrolytically decomposed in the fluidized medium and burned in the free board but cannot be completely burned within the free board. Therefore, when previously heating the above described catalyst mounted on the upper portion of free board to 600°-750° C., soot and other unburned organic materials can be completely burned.

Further, a complete combustion has been attained by establishing a catalyst reaction furnace, as a back up, behind the cyclone, considering a case that a very small amount of unburned materials passed through the catalyst.

The most preferable catalyst used in the present invention is such a catalyst as prepared by winding a coppernet (60-100 meshes) and a stainless steel net (60-100 meshes) one upon another to make a size adjusted to the inner diameter of incinerator and oxidizing it in air. The catalyst so prepared does not get out shape in use, is large in reaction surface area and can be used for a long period by supplying oxygen.

Although $SO_2$ is produced when burning up the ion-exchange resin, the catalyst can be maintained its catalyst activity without suffering toxic effect by heating at a temperature of above 650° C.

In a fluidized bed type incineration the flying-out of fluidized medium often occurs, however, such a point of advantage that the flying-out of fluidized medium can be prevented by setting up the above described catalyst above the free board has been found. This phenomenon is expected for the prevention of flying-out of radionuclide material.

EXAMPLE

The present invention will be explained more in detail with an embodiment.

An fluidized bed type incinerator apparatus for ion-exchange resin is shown in FIGURE.

The fluidized bed (2) and catalysts (4) and (10) were heated at 750° C. and 650° C., respectively.

Next, while flowing 25 1/ml of air heated in air heater (6) using a compressor (5), active alumina of 30-60 in meshes was made to a fluidized state.

Then, a mixture of anion resin and cation resin is fed into the fluidized bed (2) in approximate 0.3 Kg/h from a resin tank (1).

The ion-exchange resin was pyrolytically decomposed in the fluidized bed (2) and, after burning mostly in the free board (3), at last soot and other unburned materials were completely burned by the catalyst reaction with catalyst.

At this time the catalyst was caused a reduction reaction, but it was restored to an oxide by supplying air from a pipe fitted up on the free board.

In an incineration test without using the catalysts (4) and (10), a filter (7) made of sintered metal caused clogging immediately and so a continuos incineration test was immpossible.

Thus an incineration method of ion-exchange resin in which the production of soot is prevented was established by furnishing a catalyst.

An important point of the present process consists in furnishing a catalyst above the free board and behind the cyclone thereby making it possible to completely burn up soot and other unburned materials which cannot be burned in the fluidized bed and free board.

What is claimed is:

1. A process for combustion of ion-exchange resin which comprises introducing an ion-exchange resin and air into a fluidized bed reaction zone heated to initially combust said resin and thereafter contacting soot and other unburned materials from said fluidized bed reaction zone in a region above the fluidized bed reaction zone with a catalyst to effect further catalytic combustion.

2. The process of claim 1 wherein said catalyst comprises at least one member of the group consisting of copper oxide, iron oxide, nickel oxide and cobalt oxide.

3. The process of claim 2 which further comprises directing the combustion products to a cyclone.

4. The process of claim 3 which further comprises introducing the combustion products to a second catalyst.

5. The process of claim 4 wherein said second catalyst comprises at least one member of the group consisting of copper oxide, iron oxide, nickel oxide and cobalt oxide.

6. The process of claim 1 wherein said catalyst is prepared by winding a copper net of 60–100 mesh and a stainless steel net of 60–100 mesh together, then oxidizing them in air.

7. The process of claim 5 wherein said second catalyst is prepared by winding a copper net of 60–100 mesh and a stainless steel net of 60–100 mesh together, then oxidizing then in air.

8. A process for combustion of ion-exchange resin which comprises introducing an ion-exchange resin and air into a fluidized bed reaction zone heated to initially combust said resin and thereafter directing soot and other unburned materials from said fluidized bed reaction zone through a catalyst comprising a metallic net of 60–100 mesh containing at least one member selected from the group consisting of copper oxide, iron oxide, nickel oxide and cobalt oxide, to effect further combustion.

* * * * *